United States Patent [19]

Carter et al.

[11] 4,309,974

[45] Jan. 12, 1982

[54] GAME FINDER HUNTING BOW COMBINATION

[76] Inventors: James R. Carter, H-5 Deertrack Villas, Deerfield Plantation, Surfside; Hope L. Willard, Rte. 2, Box 369, N. Myrtle Beach, both of S.C.

[21] Appl. No.: 968,124

[22] Filed: Dec. 11, 1978

[51] Int. Cl.[3] ..... F41B 5/00

[52] U.S. Cl. ..... 124/23 R; 242/146; 242/171; 43/6; 124/80

[58] Field of Search ..... 124/24 R, 24 A, 23 R, 124/25, 86, 80, 17, 16; 43/6, 19, 20, 22, 24; 112/279; 242/146, 171

[56] References Cited

U.S. PATENT DOCUMENTS

| | | | |
|---|---|---|---|
| 736,051 | 8/1903 | Adams . | |
| 2,614,772 | 10/1952 | Epstein | 242/146 |
| 2,812,756 | 11/1957 | Myers | 124/88 X |
| 2,812,756 | 11/1957 | Meyers . | |
| 2,904,338 | 9/1959 | Podufal . | |
| 2,938,514 | 5/1960 | Berg | 124/88 X |
| 3,033,360 | 5/1962 | Ledoux | 242/171 |
| 3,059,370 | 10/1962 | Moore | 124/23 R X |
| 3,129,525 | 4/1964 | Lewis | 124/24 R X |
| 3,377,999 | 4/1968 | Reynolds | 124/24 R |
| 3,614,947 | 10/1971 | Feldman . | |
| 3,683,882 | 8/1972 | Braxton . | |
| 3,949,730 | 4/1976 | Schoenberger | 124/24 R |
| 4,024,667 | 5/1977 | Wegener . | |

FOREIGN PATENT DOCUMENTS

| | | | |
|---|---|---|---|
| 583045 | 9/1959 | Canada | 124/80 |
| 917311 | 11/1946 | France | 43/6 |
| 413030 | 3/1946 | Italy | 124/80 |

*Primary Examiner*—Richard C. Pinkham
*Assistant Examiner*—William R. Browne
*Attorney, Agent, or Firm*—Craig and Antonelli

[57] ABSTRACT pg,1 An archery bow with a game finder attachment enables game shot with an arrow to be located over 1200 feet from the point of shot yet does not effect the flight of the arrow at reasonable distances. In the preferred embodiment the attachment includes an elongated tubular canister which is easily mounted to the bow and disposable prepackaged string, wound in a manner that causes the inner wound end of the string to be fed first and the outwardly wound string last so as to substantially reduce the amount of drag imposed upon the arrow to which it is attached, which can simply be dropped into the elongated canister.

4 Claims, 3 Drawing Figures

GAME FINDER HUNTING BOW COMBINATION

BACKGROUND AND SUMMARY OF THE INVENTION

The present invention relates to archery bow hunting and more particularly to a means by which game that has been shot with an arrow can be assuredly found. A problem that hunters have often faced is that, after finally getting that one good shot at a deer or other game, the injured deer or game has run several hundred yards before dropping with the result that the hunter's efforts are wasted because he is unable to locate the animal that he has shot.

It has long been known to attach reels of string to bows with the end of the string secured to the arrow. These arrangements have primarily been utilized for bow and spear fishing, and to a lesser extent as a means for carrying a line or rope to an elevated or inaccessible point. These arrangements for mounting a reel of line to a bow can be substantially characterized by two types. The oldest form for mounting a spool or reel wound with string upon a bow is typified by the arrangements disclosed in U.S. Pat. Nos. 736,051; 2,812,756; 2,904,338; and 3,377,999. In these patents, a spool or reel is mounted to the bow with its longitudinal axis extending substantially parallel to the longitudinal axis of the arrow to be shot with the string wound about the spool axis. With such arrangements, when an arrow was shot, the spool did not rotate and the string was caused to feed off the spool by the pull of the arrow.

The second type of arrangement is typified by U.S. Pat. Nos. 3,614,947; 3,683,882; and 4,024,667. In these patents, conventional winding type fishing reels of the type normally used on a rod for casting a hook are mounted to the bow and the string is fed off upon launching of the arrow in a manner well known for these types of reels.

The prior art reels were not designed and not intended to feed string at the velocities at which an arrow is launched by a high-powered hunting bow, nor to accept the backlash force which occurs when the arrow applies the initial pull to the string after being shot.

The function of the string in a fishing environment is not to locate the arrow, but to retrieve the fish that has been shot by the arrow attached thereto which requires the string to be strong enough to stop and turn a fish of any size as well as draw it close enough to be retrieved from the water. Therefore, these devices utilize a heavy line which coupled with the basic deficiencies of the reels from which they are unwound, impose a great drag effect upon the arrow shot, thereby effecting both the distance and accuracy with which the arrow can be shot.

Still further, since the quarry often run several hundred yards before dropping after being shot with an arrow, a reel of the prior art types would have to be so large and heavy to carry sufficient line that it would render use of the bow awkward and cumbersome.

In this regard, it is noted that the problems of the drag effect and the amount of line required, are not of particularly great significance in the field of bow fishing to which the prior art arrangements are directed, or for that matter, in hunting small game such as rabbits or fowl because such game or fish can be shot as close as 10 yards or a few feet, respectively, and because of the small size of the quarry, they are rarely shot at a distance of 20 yards or more, and the arrow is launched in a downward direction. As a result, the effective range of accuracy of 5 to 10 yards which is obtainable with such devices when aimed in an initially upward trajectory is of no real significance.

On the other hand, larger game such as deer are normally hunted at distances of 20 to 30 yards with the arrow launched in an initially upward trajectory such that the limitations of the prior art devices with respect to the drag imposed upon the arrow make the prior art string and reel arrangements totally unsuitable for use in hunting such quarry.

Accordingly, it is an object of the present invention to provide an arrangement whereby string can be carried upon a bow wound in a manner that enables a minimum amount of drag to be imposed to an arrow which is attached thereto in flight.

It is a further object to provide a means to mount extremely long lengths of string upon a bow in a manner that is lightweight and will not interfere with use of the bow.

These and other objects of the present invention are achieved in a preferred embodiment by the use of specially wound prepackaged string that is merely dropped into a tubular canister that is closed at its ends by closure caps, one of which has a central opening through which the end of the string to be attached to the bow can be fed out of the canister. The canister being of an elongated tubular configuration, is easily mounted to the bow by a leather strap or other bracket member.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
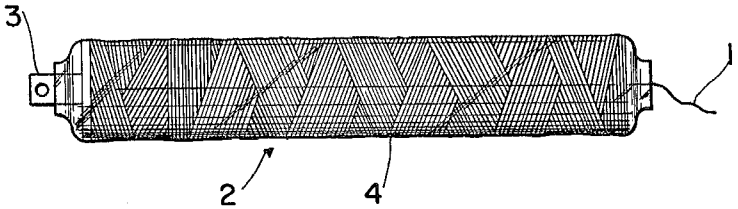
PRIOR ART FIG. 1
FIG. 1 is an illustration of a prior art package of string wound so as to unwind from the inside towards the outside.

In order to ensure that accuracy is maintained when using a bow and arrow to hunt game such as deer at distances averaging 20 to 30 yards, it is important that the string be light in weight and able to be unravelled in a manner that imposes a minimum of backlash and drag. To be able to locate the quarry in those instances when it has run a thousand feet or more after being hit, it is necessary for the line to be carried on the bow in a compact manner if it is not to render the bow heavy and cumbersome. In FIG. 1, a prior art packaged string which applicants have found suitable to the task is illustrated. Such packaged string is sold by Thomas Industries, Inc. and Jet Line Products, Inc. of Matthews, N.C. under the name "Tag-Along Line Packages", and the package No. 1704T has been found by applicants to be the most suitable size for the purposes disclosed herein.

The string 1 in these packages indicated generally at 2 in the drawings is a flat dental floss like string that is wound in such a manner that it is unwound from the inside of the package toward the outside of the package, i.e., layers of string are built up circumferentially one upon another in a manner that the circumferential outermost end of the string remains with the package and the centermost end of the string will be attached to the arrow and as the string unwinds the circumference of the wound string remains the same due to it being unravelled internally. The line or string package has an apertured end member 3 which has a function with regard to its prior art use in threading the line through conduits, but which has no function with respect to the present invention. The spool of line with the exception of the apertured end of the member 3 is tightly enclosed within a thin tubular enveloping film 4 that is transparent as shown in FIG. 1.

Since the particular manner of winding is of particular importance to the usefulness of the line, the line cannot be removed from the package prior to use and must be disposed of after use. Accordingly, a problem faced by applicants was that of devising a means for utilizing this prior art conduit line in the context of archery bow hunting. Early attempts to merely strap or otherwise secure the package directly to the bow proved unsuccessful because of the manner of packaging of the line. That is, since the film 4 has virtually no compressive strength, after approximately half of the line had been fed out of the package, the thickness of the wound string remaining in the package became insufficient to sustain the clamping forces and the package would collapse preventing further unwinding of the line 1 and/or detachment of the package from the bow.

Figure 3:
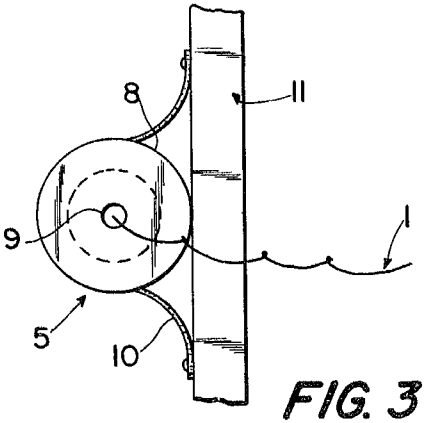
FIG. 3 is a frontal view of the bow and preferred embodiment of FIG. 2.
Figure 2:
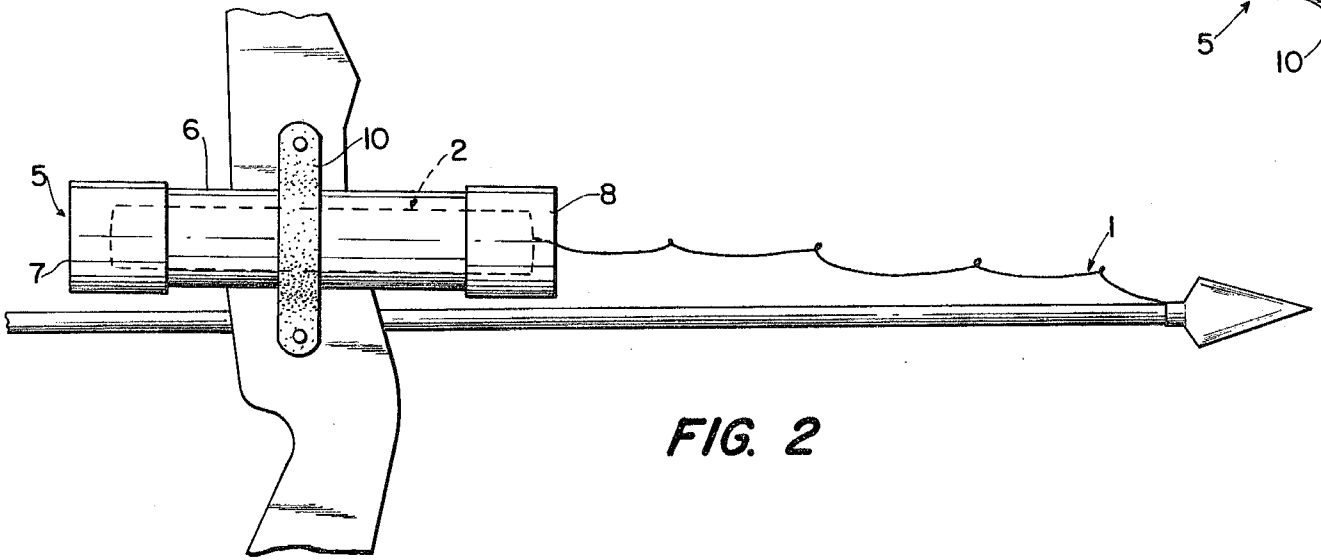
FIG. 2 is a partial side elevational view of a hunting bow and arrow with a preferred embodiment of the present invention shown attached thereto.

In order to overcome these problems, applicants have devised, according to a preferred embodiment, an elongated tubular holder shown generally at 5 in FIGS. 2 and 3. This holder is formed of one and one-quarter inch PVC conduit which is provided with tightly and removably fitted end caps 7 and 8 at each end so that the overall length of the line holder is approximately 7 inches long. The end cap 8 is provided with an aperture 9 through which the inner end of the line can be threaded before attachment to the arrow at the base of the broad head, such as by tying thereto. The holder 5 is securable to the side of the bow so as to extend parallel to the axis of an arrow to be shot above the hand grip of the bow and substantially in line with or slightly above the line at which the arrow extends across the bow handle portion by means of a leather strip 10 which can be removably screwed to the bow 11, or other conventional detachable mounting brackets suitable for tightly gripping a tubular member can be used.

The use of applicants' preferred embodiment will now be described. The end cap 8 is removed from the tubular member 6 and a package of line 2 is dropped therein with the end member 3 directed rearwardly. The line 1 is then threaded through the cap 8 which is then reapplied to the tubular member 6 after which time the line 1 is tied to the arrow adjacent its broad head.

The arrow is then ready for use and when shot the line will be dispensed with a minimum effect upon the arrow (in use applicants have found that the line has a negligible effect upon the arrow at distances up to 20 yards and at distances over 30 yards a tendency to drop an inch has been experienced which is of no consequence when hunting game such as deer and easily compensated for). If the arrow misses its target, since the line cannot be wound and since over 1200 feet of 35 pound test line can be packaged to fit within a holder 5 of the size described above, the hunter need only snip off the dispensed portion and then tie the new inner end to the arrow shot or to another arrow.

On the other hand, should the arrow find its mark and the quarry take off in flight thereafter, the large quantity of string carried within the holder should be sufficient to stay with the quarry until it drops, thereby providing a means for the hunter to find it quickly and easily by following the line. Furthermore, since the line is only of 35 pound test, not only does it not effect flight of the arrow by reason of its weight, it may also be easily broken, to prevent unwanted payout of the line, by the user in those instances when he perceives that the hit is obviously not of a fatal nature. Similarly, should the end of the line be reached, no damage will result to either the bow or holder since the end of the line within the holder 5 is not attached thereto.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A game hunting combination comprising:

(a) an archery bow having a central section disposed between the ends of the bow;

(b) an elongated hollow tubular housing means closed at both ends, one of said closed ends being formed by a removable cap having a centrally positioned aperture therein;

(c) means for attaching said housing means to said central section of the bow with its longitudinal axis directed generally perpendicular thereto;

(d) a package of lightweight line wound, from an innermost wound free end to an outermost wound end, in a plurality of layers in a manner permitting said line to be unwound by pulling force applied to said innermost would end, said package being inserted within said housing means with said innermost wound free end extending through said aperture; and (e) a captive arrow secured to said free end of the line.

2. A game hunting combination according to claim 1, wherein said package of line includes a circumferentially enclosing plastic film surrounding said wound line, and wherein said package is operationally received within said housing means without removal of said film and by only slidingly inserting said package within said housing means and extending said innermost end of the line through said aperture.

3. A game hunting combination according to claims 1 or 2, wherein said housing means is formed of plastic conduit closed at both ends by force-fit closure caps, one of which is said removable cap.

4. A game hunting combination according to claims 1 or 2, wherein said arrow has a broadhead and said free end of the line is secured at the base of said broadhead.

* * * * *

UNITED STATES PATENT AND TRADEMARK OFFICE

CERTIFICATE OF CORRECTION

PATENT NO. : 4,309,974

DATED : January 12, 1982

INVENTOR(S) : James R. CARTER and Hope L. WILLARD

It is certified that error appears in the above-identified patent and that said Letters Patent are hereby corrected as shown below:

Claim 1, clause (d), line 5, change "would" to --wound--.

Signed and Sealed this

*Thirty-first* Day of *August 1982*

[SEAL]

*Attest:*

GERALD J. MOSSINGHOFF

*Attesting Officer*

*Commissioner of Patents and Trademarks*